US009686826B2

(12) United States Patent
Tai

(10) Patent No.: US 9,686,826 B2
(45) Date of Patent: Jun. 20, 2017

(54) MICROWAVE MOISTURE LOCK COVER

(71) Applicant: Chih-Cheng Tai, Campbell, CA (US)

(72) Inventor: Chih-Cheng Tai, Campbell, CA (US)

( * ) Notice: Subject to any disclaimer, the term of this patent is extended or adjusted under 35 U.S.C. 154(b) by 220 days.

(21) Appl. No.: 13/859,971

(22) Filed: Apr. 10, 2013

(65) Prior Publication Data

US 2013/0284727 A1 Oct. 31, 2013

Related U.S. Application Data

(60) Provisional application No. 61/624,022, filed on Apr. 13, 2012.

(51) Int. Cl.
*H05B 6/64* (2006.01)
*F24C 7/02* (2006.01)

(52) U.S. Cl.
CPC ..... *H05B 6/6479* (2013.01); *F24C 7/02* (2013.01); *H05B 6/6408* (2013.01)

(58) Field of Classification Search
USPC ..... 219/730, 731, 733, 734; 99/448; 426/106, 665
See application file for complete search history.

(56) References Cited

U.S. PATENT DOCUMENTS 4,018,355 A * 4/1977 Ando ..... 220/522
4,413,167 A * 11/1983 Martel et al. ..... 219/729
4,705,927 A * 11/1987 Levendusky et al. ..... 219/731
4,828,140 A * 5/1989 Henderson ..... 220/369
4,839,484 A * 6/1989 Senba ..... 219/731
4,853,509 A * 8/1989 Murakami ..... 219/731
4,871,892 A * 10/1989 Samford ..... 219/733
4,906,806 A * 3/1990 Levinson ..... 219/731
4,923,704 A * 5/1990 Levinson ..... 426/243
4,952,765 A * 8/1990 Toyosawa ..... 219/735
5,126,520 A * 6/1992 Nottingham et al. ..... 219/729
5,277,326 A * 1/1994 Chiba ..... 220/231
5,310,981 A * 5/1994 Sarnoff ..... A47J 27/088 126/369
5,404,803 A 4/1995 Glucksman
5,521,361 A * 5/1996 Strait, Jr. ..... 219/731
5,543,606 A * 8/1996 Gics ..... 219/730
5,558,798 A * 9/1996 Tsai ..... 219/731
5,597,086 A * 1/1997 King-Shui ..... 220/592.16
5,750,967 A * 5/1998 Sprauer, Jr. ..... 219/735
5,865,104 A * 2/1999 Sham et al. ..... 99/417
(Continued)

OTHER PUBLICATIONS

International Preliminary Report on Patentability mailed Oct. 14, 2014.

*Primary Examiner* — Quang D Thanh
*Assistant Examiner* — Renee Larose

(57) ABSTRACT

Methods of and device for retaining a moisture level of a food heated/reheated in a microwave oven are provided. The device includes a microwave splatter cover, a lid, or a lunch box integrated with a steam generator. The device is able to contain a steam generator capable of generating steam from added water when a microwave radiation is provided. The steam generator is able to rotatably couple with the center of the microwave cover. Water added to the cover is able to be temporary stored on the cover and subsequently flow to a dish structure underneath the cover. Alternatively, water is able to be added directly through a hole on the cover to the dish structure.

19 Claims, 24 Drawing Sheets

(56) References Cited

U.S. PATENT DOCUMENTS

| | | | | |
|---|---|---|---|---|
| 5,974,686 | A * | 11/1999 | Nomura et al. | 34/263 |
| 6,035,769 | A * | 3/2000 | Nomura et al. | 99/472 |
| 6,105,811 | A * | 8/2000 | Alfred | 220/369 |
| 6,125,738 | A * | 10/2000 | Poister | 99/339 |
| 6,129,234 | A * | 10/2000 | Culig et al. | 220/573.1 |
| 6,196,115 | B1 * | 3/2001 | Tsao | 99/339 |
| 6,229,131 | B1 * | 5/2001 | Koochaki | 219/731 |
| 6,298,773 | B1 * | 10/2001 | Cali | 99/337 |
| 6,307,193 | B1 * | 10/2001 | Toole | 219/735 |
| 6,387,430 | B1 * | 5/2002 | Gillette et al. | 426/520 |
| 6,557,462 | B1 * | 5/2003 | Wang | 99/472 |
| 6,675,982 | B2 * | 1/2004 | Heil et al. | 220/212 |
| 6,698,420 | B2 * | 3/2004 | Anthony | A47J 37/101 126/374.1 |
| 6,730,895 | B2 * | 5/2004 | Kim | 219/682 |
| 6,825,452 | B2 * | 11/2004 | Oh | 219/682 |
| 6,878,910 | B2 * | 4/2005 | Kim et al. | 219/682 |
| 6,953,920 | B2 * | 10/2005 | Jeon | 219/682 |
| 7,030,346 | B1 * | 4/2006 | Miao | A47J 36/027 219/682 |
| 7,341,754 | B1 * | 3/2008 | Loh et al. | 426/115 |
| 7,717,031 | B1 * | 5/2010 | Cornfield | 99/413 |
| 7,726,505 | B2 * | 6/2010 | Cheung | 220/231 |
| 8,247,751 | B2 * | 8/2012 | Jagannathan | 219/735 |
| 2002/0157542 | A1 * | 10/2002 | Pretre | 99/417 |
| 2003/0145741 | A1 * | 8/2003 | Holl | 99/450 |
| 2004/0035860 | A1 * | 2/2004 | Oh | 219/682 |
| 2004/0040954 | A1 * | 3/2004 | Kim | 219/681 |
| 2004/0118836 | A1 * | 6/2004 | Kim | 219/682 |
| 2005/0040160 | A1 * | 2/2005 | Jeon | 219/682 |
| 2010/0200574 | A1 * | 8/2010 | Pralus | 219/734 |
| 2011/0259881 | A1 * | 10/2011 | Jagannathan | A47J 27/088 219/679 |

* cited by examiner

MICROWAVE MOISTURE LOCK COVER

CROSS-REFERENCE TO RELATED APPLICATION(S)

The present invention claims priority to the U.S. provisional patent application Ser. No. 61/624,022 titled Microwave Steamer, filed on Apr. 13, 2012, which is incorporated by reference in its entirety for all purposes.

FIELD OF INVENTION

The present invention relates to method of and device for maintaining and/or enhancing the quality of food that is heated in a microwave oven. Specifically, the present invention relates to methods of and devices for enhancing and/or maintaining the moisture level of food that is heated in a microwave oven.

BACKGROUND OF THE INVENTION

Microwave ovens are often used to heat up food and drinks. Nonetheless, food that is heated up by microwave becomes dry and hard, because water inside the food is vaporized and escaping from the food.

SUMMARY OF THE INVENTION

Methods of and device for retaining a moisture level of a food heated/reheated in a microwave oven are provided. In an aspect, a microwave food heating device comprising a cover portion and a steam generator coupled with the cover portion. In some embodiments, the cover portion comprises a water storage recess. In other embodiments, the steam generator comprises a water container. In some other embodiments, the water container comprises a dish structure. In some embodiments, the microwave food heating device comprises a gap allowing steam to pass between the dish structure and a bottom side of the cover portion. In other embodiments, the steam generator comprises a handle going through an aperture near a center portion of the cover portion. In some other embodiments, the handle comprises a water stopper. In some embodiments, the handle is rotatably coupled with a center portion of the cover portion. In other embodiments, the water stopper closes a hole in the cover when the handle rotates to a pre-determined position. In some other embodiments, the steam generator is made of silicone. In some embodiments, the cover portion is made of polypropylene.

In another aspect, a microwave splatter cover comprising a cover structure and a water container coupled with the cover structure. In some embodiments, the water container comprises a dish structure. In other embodiments, the dish structure comprises a body substantially parallel to a top portion of the cover structure. In some other embodiments, the cover structure comprises a fluid path, which couples with the water container. In some embodiments, the cover structure comprises a recess allowing water to be temporary stored until a hole in the cover structure is opened for draining the water to the water container. In other embodiments, the water container is instantly attachable to and detachable from the cover structure.

In another aspect, a method of retaining water in a microwave reheated food comprising generating steam at a water chamber coupled with a cover structure from added water by using a microwave radiation and covering the food with the steam. In some embodiments, the method further comprises pouring the water on the cover structure. In some other embodiments, the method further comprises temporarily storing the water on the cover structure and allowing the water to flow to the water chamber. In some embodiments, the water chamber comprises a dish structure. In other embodiments, the water chamber is rotatably coupled with an aperture approximately at a center of the cover structure. In some other embodiments, the water chamber comprises a handle comprises a solid body.

DETAILED DESCRIPTION OF THE INVENTION

Figure 1A:
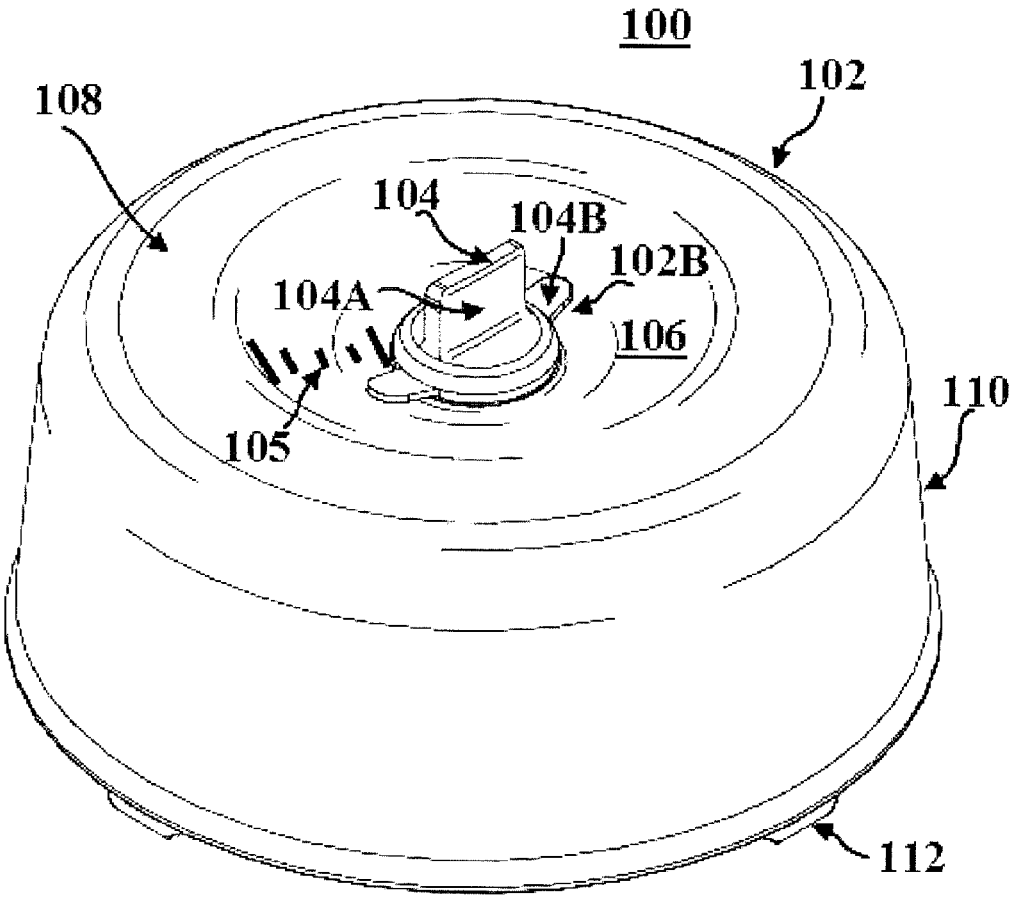
FIGS. 1A-1F illustrate a microwave steam cover in accordance with some embodiments of the present invention.
Figure 1B:
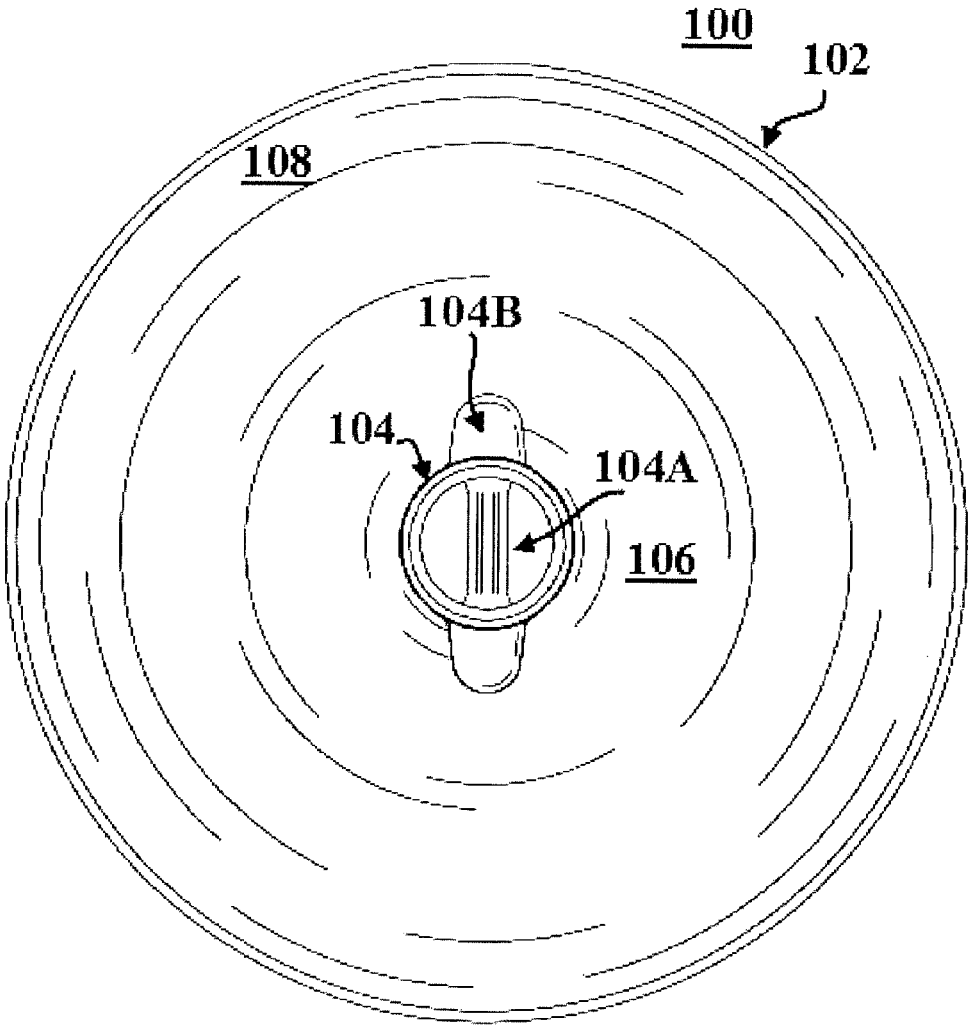
Figure 1C:
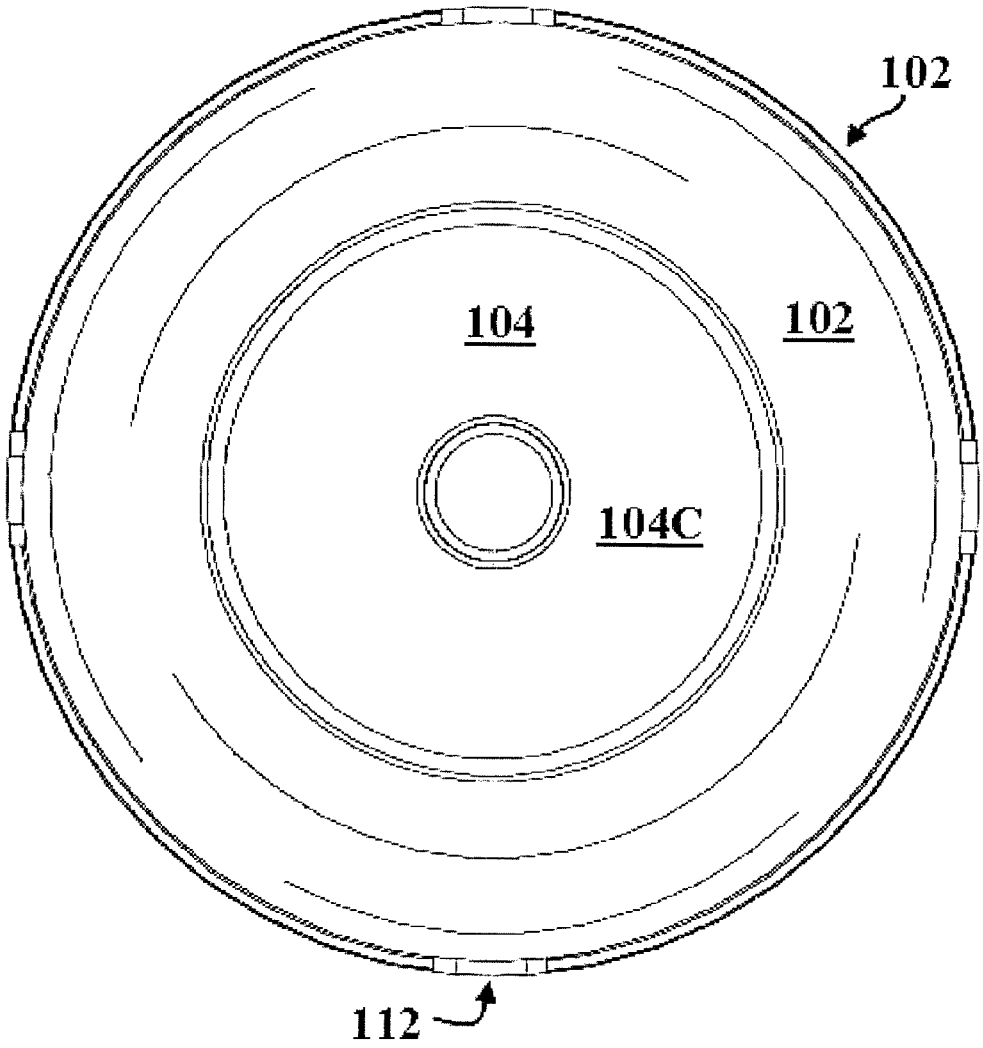
Figure 1D:
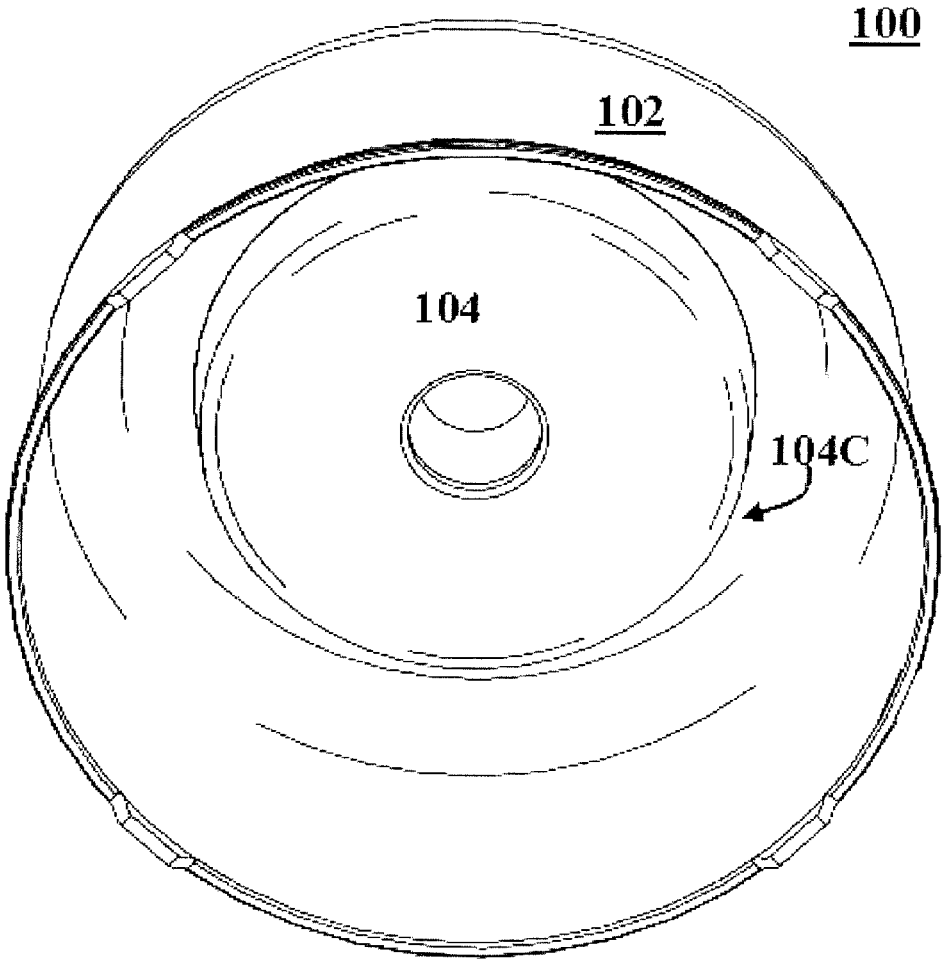
Figure 1E:
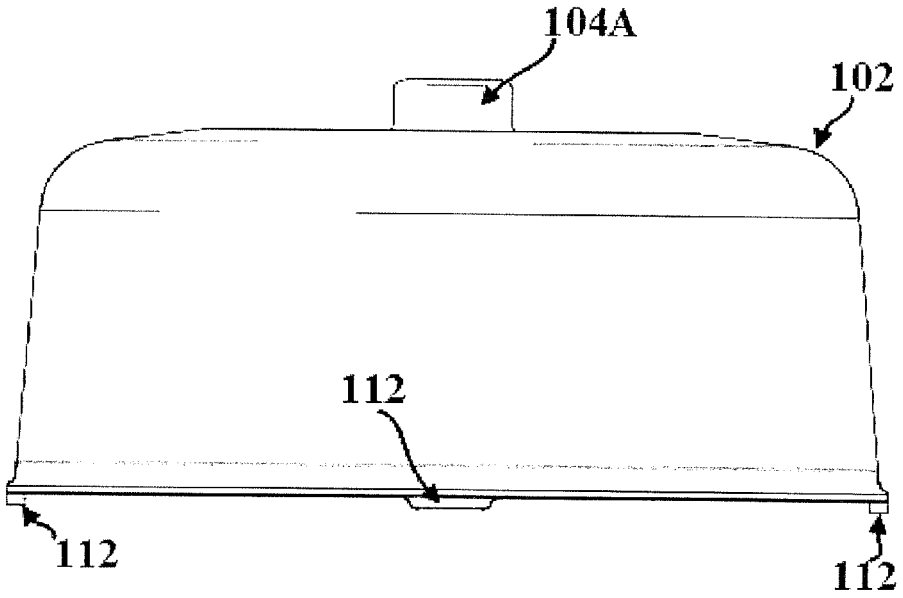
Figure 1F:
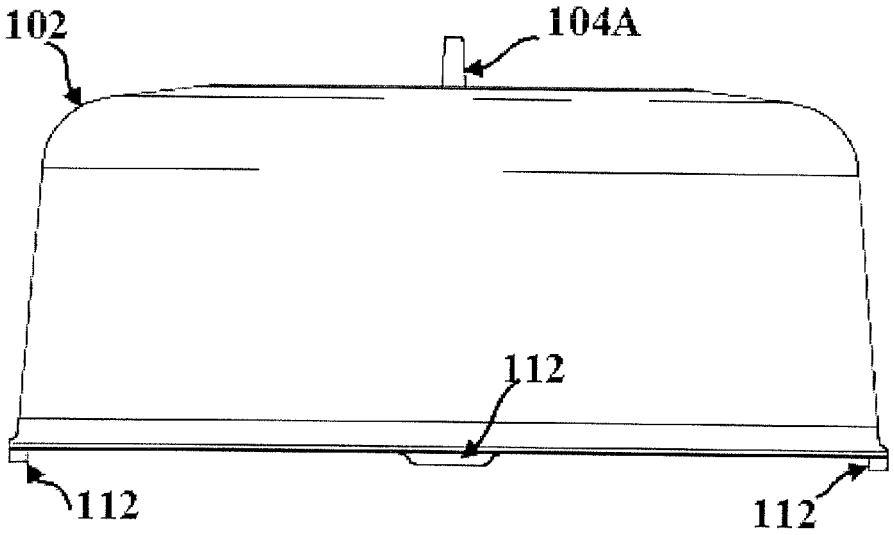

FIGS. 1A-1F illustrate a microwave steam cover 100 in accordance with some embodiments of the present invention. FIG. 1A is a perspective view of the microwave steam cover 100. FIG. 1B is a top view of the microwave steam cover 100. FIGS. 1C and 1D are the bottom views of the microwave steam cover 100. FIGS. 1E and 1F are side views of the microwave steam cover 100. FIG. 1E shows a side view of the microwave steam cover 100 rotates 90 degree from the side view of FIG. 1F. The same numbers for labeling the same components are applicable throughout all figures. For example, cover portion 102 in FIG. 1A is the same cover portion 102 in FIG. 1B.

Referring to FIGS. 1A-1F, in some embodiments, the cover 100 comprises a cover portion 102 and a steam generator 104. In some other embodiments, the steam generator 104 is able to be instantly attached to and detached from the cover portion 102 by a pinch/snap-and-push action of a user fingers. In some embodiments, the cover portion 102 is able to be made of polypropylene and the steam generator 104 is able to be made of silicone. A person of ordinary skill in the art appreciates that any other materials are able to be used to make the cover 100 and its components, such as the cover portion 102 and the steam generator 104. The materials are able to be any polymeric materials, such as polyethylene (PE), polyvinyl chloride (PVC), acrylonitrile butadiene styrene (ABS), polycarbonate (PC), stainless steels, iron, copper, and any other materials.

In some embodiments, the cover 100 comprises a liquid storage area 106. The liquid storage area 106 can be a concave/recess from a surface on the top portion 108 of the cover 100. The liquid storage area is able to be used for water storage. The liquid storage area 106 can be a bowl shape. In some embodiments, the liquid storage area 106 contains an amount meter 105 for measuring an amount of liquid that is added at the liquid storage area 106. In some embodiments, the meter comprises scales in cubic centimeter (cc), such that a user is able to measure the amount of liquid (such as water) that is added to the liquid storage area 106.

In some embodiments, the cover 100 comprises a side wall 110. The height of the side wall 110 is able to be 2-5 inches. In some embodiments, the side wall 110 is collapsible and/or expandable along the side wall 110. In other embodiments, the side wall 110 is mechanically detachable/attachable to the top portion 108. In some other embodiments, the side wall 110 is instantly detachable/attachable to the top portion 108, such as with a locking mechanism. In some embodiments, the cover 100 does not contain the side wall 110, such that the cover 100 forms a lid structure. In some other embodiments, the cover 100 is couple with a food container, such as a typical lunch/food box, forming a box set including a food container with a lid having a streamer function provided by the steamer generator 104. The typical lunch box can be, for example, Rubbermaid® 7K9700CIRED Lock-its 5¼-Cup Divided Food-Storage Container with Lid, and Insulated Lunch Boxes and Portable Plastic Lunch Containers by Tupperware®, and GladWare® Containers. In some embodiments, the cover 100 comprises stands 112, which couple with the bottom side of the side wall 110.

The steam generator 104 is able to comprise a dish-like structure 104C capable of storing water. In some embodiments, the steam generator 104 comprises a handle 104A, a fluid stopper 104B, and a dish structure 104C. In some other embodiments, the steam generator 104 going through the main opening 102A on the cover portion 102 having the handle 104A above the surface of the main opening 102A and the dish-like structure 104C below the surface of the main opening 102A. The fluid stopper 104B is able to be used to open or close the side opening 102B by twisting the handle 104A to move circularly, such that steam generated by the microwave radiation is able to be prevented from coming out from the side opening 102B, which is an advantageous function.

In some embodiments, the steam generator 104 is made of silicone. In some embodiments, the steam generator 104 has hardness around 6 or 7 that is understood in the art of silicone manufacturing industry. A person of ordinary skill the art appreciates that the steam generator is able to be in any hardness level so long as it is able to support the weight of water without substantial spilling. In some embodiments, the cover portion 102 is made of polypropylene. A person of ordinary skill in the art appreciates that any other plastic or polymeric materials, such as silicone, are able to be used to make the cover portion 102. In some embodiments, the cover portion 102 and the steam generator 104 are made in a non-separable unit, such as molded together. In some embodiments, the cover portion 102 and steam generator 104 are formed simultaneously in an injection mold.

In use, a user is able to cover a plate with food to be warmed with the microwave steam cover 100 in a microwave oven, twist the handle 104A to open the side opening 102B, add water to the liquid storage area 106, allow the water to flow from the liquid storage area 106 to the dish structure 104C that is located inside the cover portion 102, twist the handle 104A making the fluid stopper 104B close the side opening 102B, set and start the microwave oven for a pre-determined time, such as 1 minutes, converting the added water into steam to lock the moisture in the food heated and remove the microwave steam cover 100.

When a microwave radiation is applied, the water in the dish like structure 104C absorbs at least a portion of the microwave radiation and is vaporized into steam. The term steam is able to be used interchangeable with the term vapor, water vapor, or heated moisture in some embodiments. The steam comes out from the dish like structure 104C, confined within/under the cover portion 102, and forms a vapor covered environment, so that the food to be heated is able to remain moist. Similar principles apply to the embodiments disclosed in the present specification. A person of ordinary skill the art appreciates that other fluid, gel, solid, are able to be used to replace or used together with water. For example, a vitamin solid tablet or liquid is able to be added to the water to form a vitamin enhanced vapor. In another example, Swiss cheese is added to the dish like structure 104C, such that a cheese flavored vapor environment is able to be created.

Figure 2A:
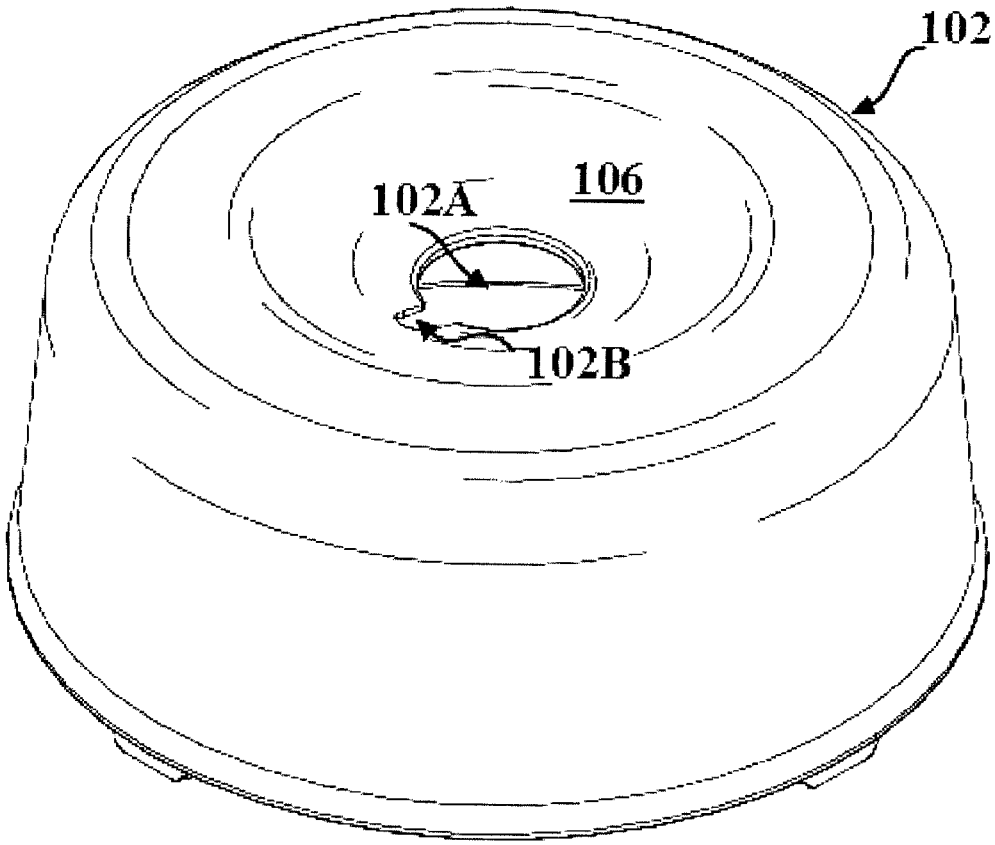
FIGS. 2A-2E illustrate the cover portion of the microwave steam cover in accordance with some embodiments of the present invention.
Figure 2B:
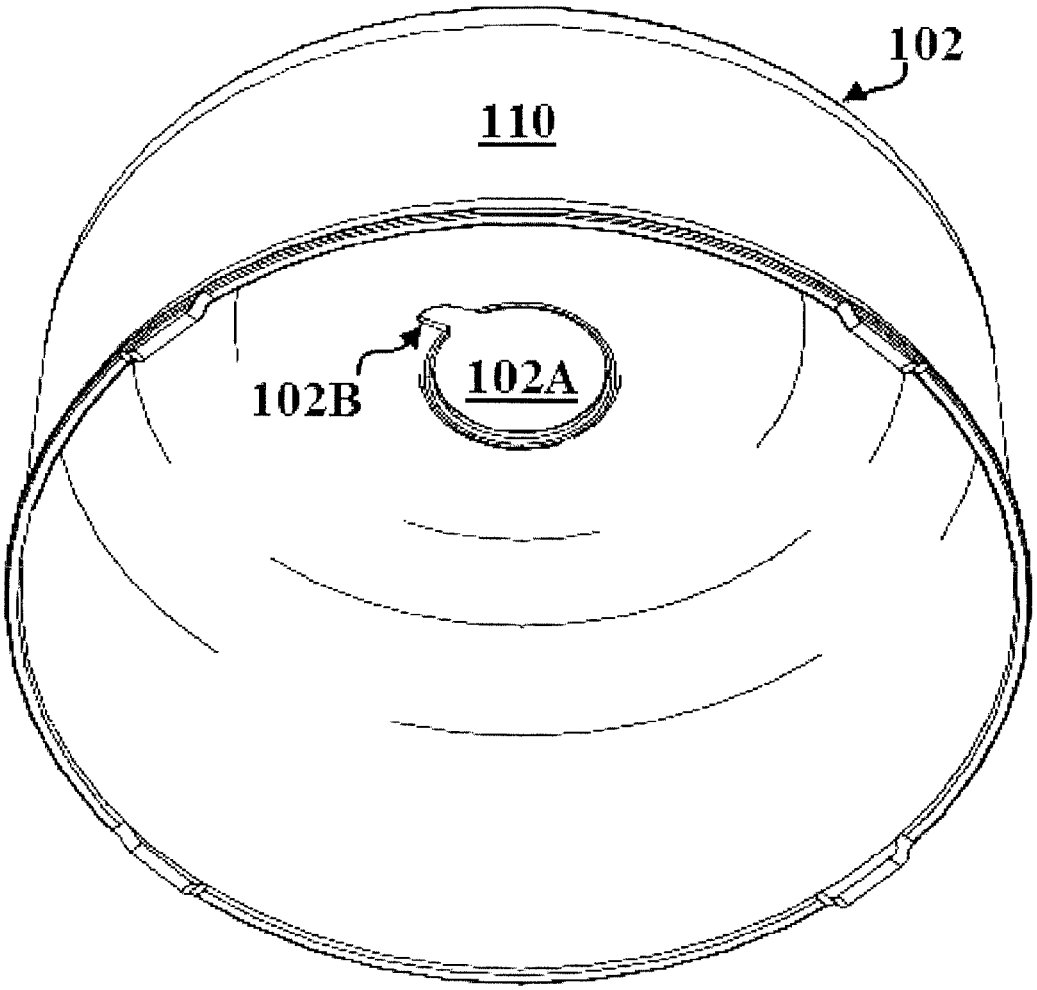
Figure 2C:
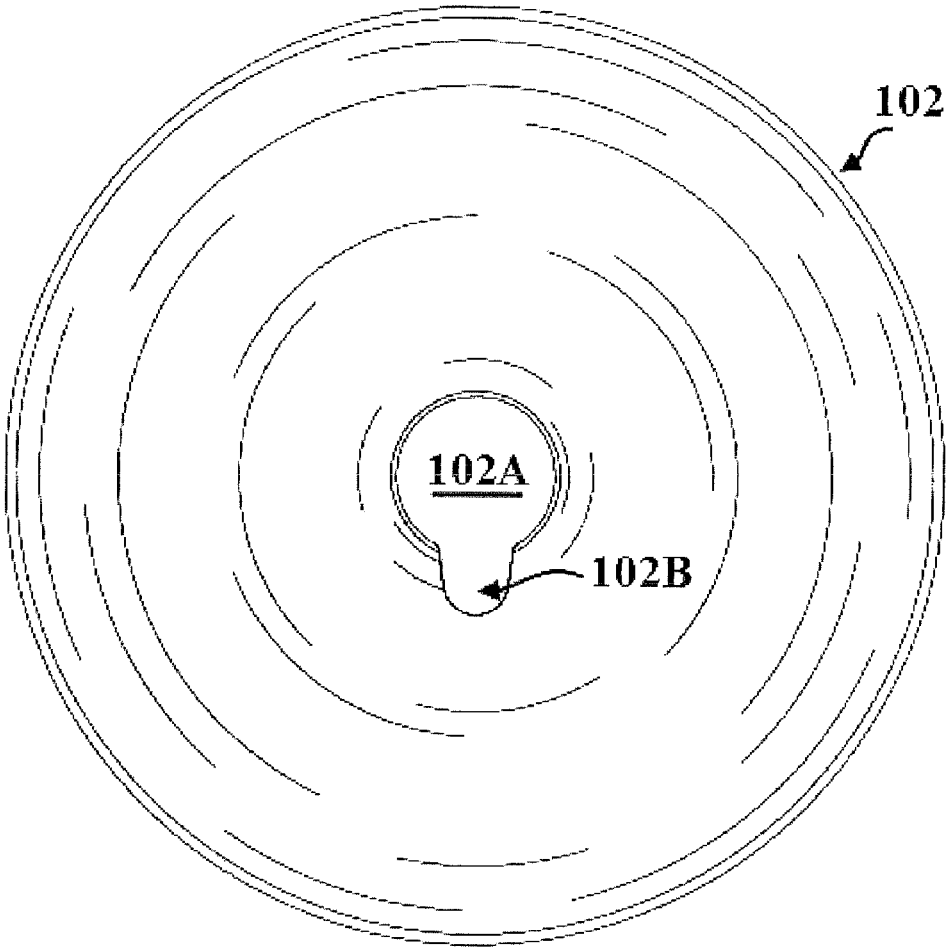
Figure 2D:
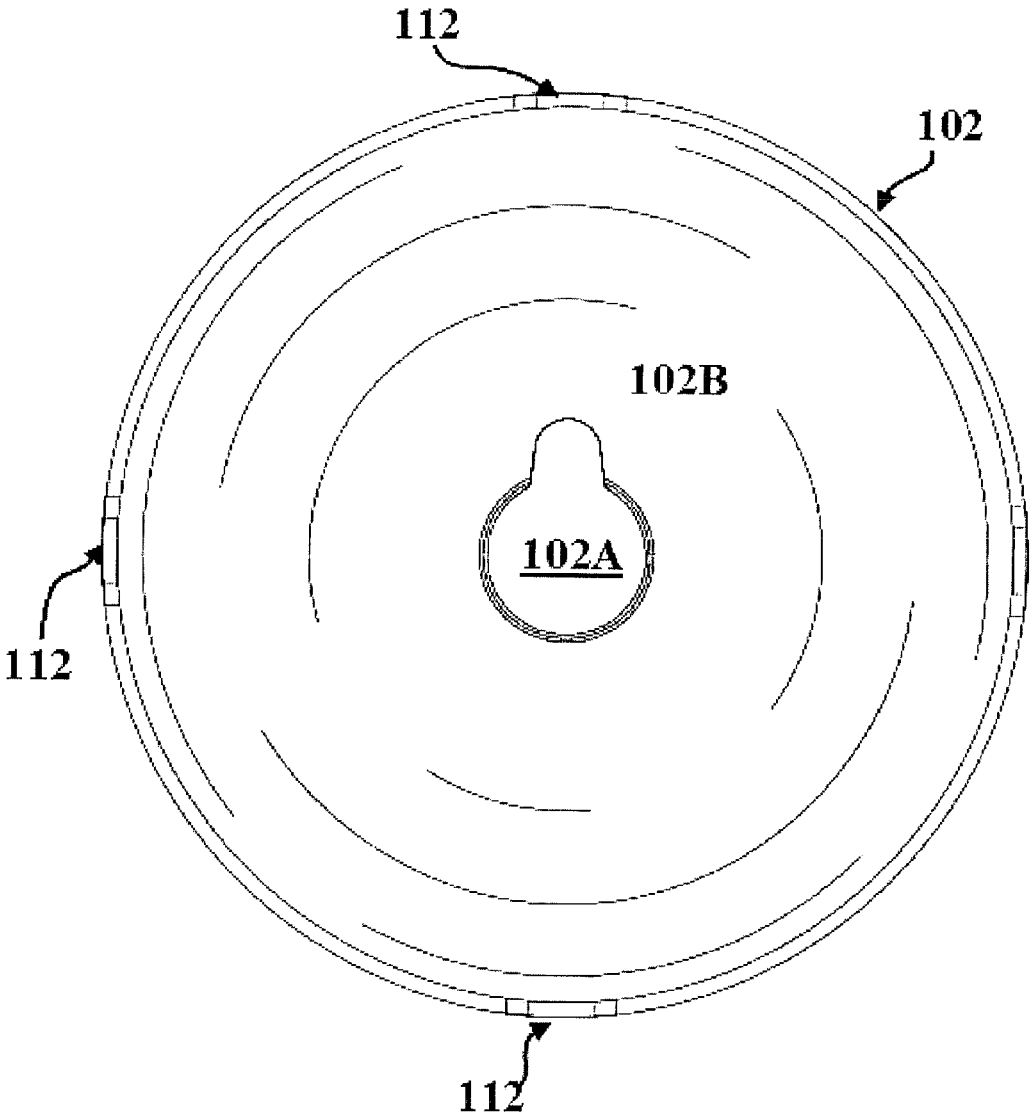
Figure 2E:
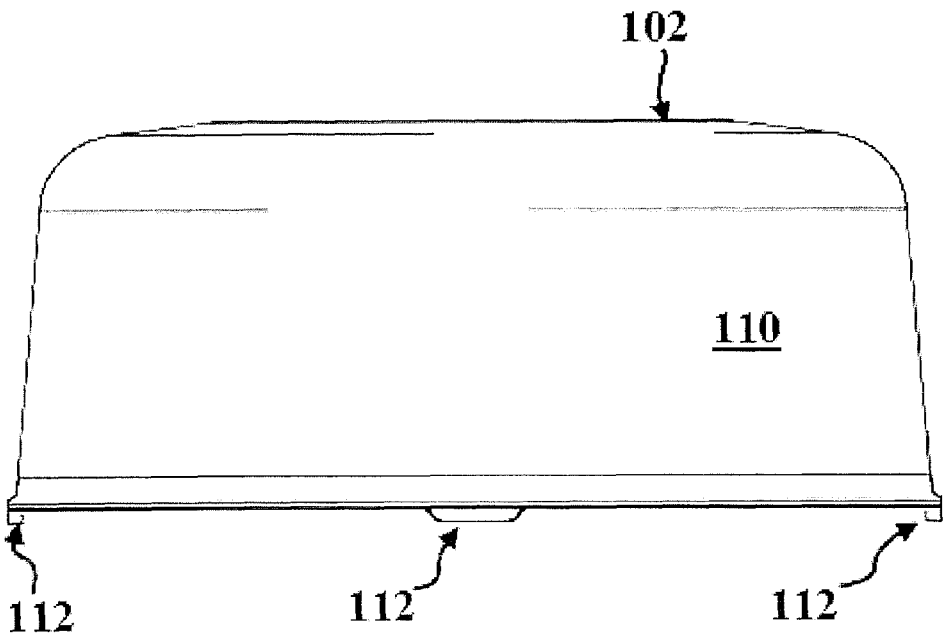
Figure 3A:
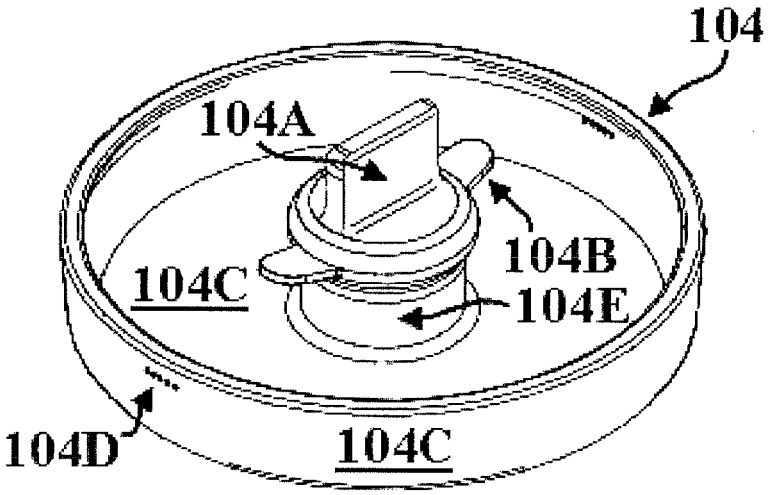
FIGS. 3A-3F illustrate the steam generator of the microwave steam cover in accordance with some embodiments of the present invention.
Figure 3B:
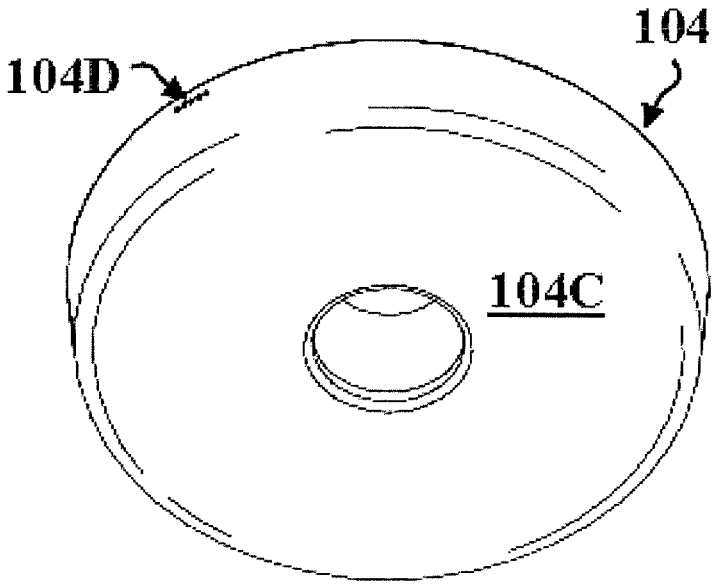
Figure 3C:
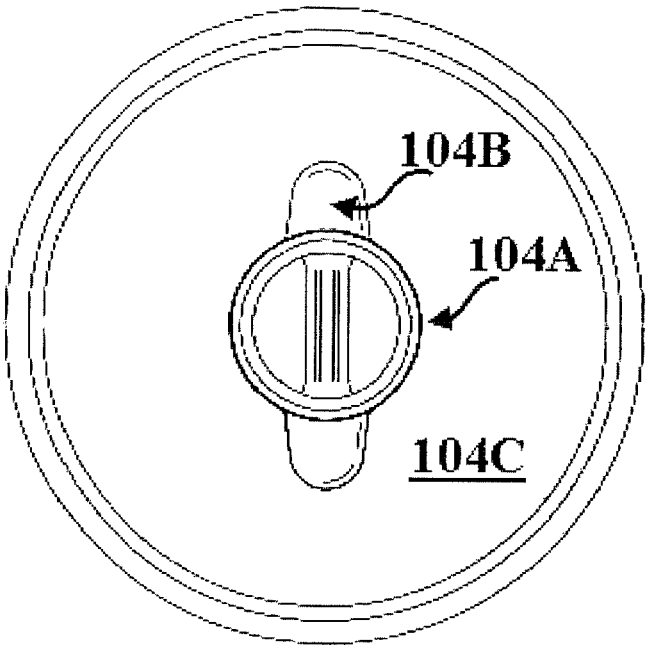
Figure 3D:
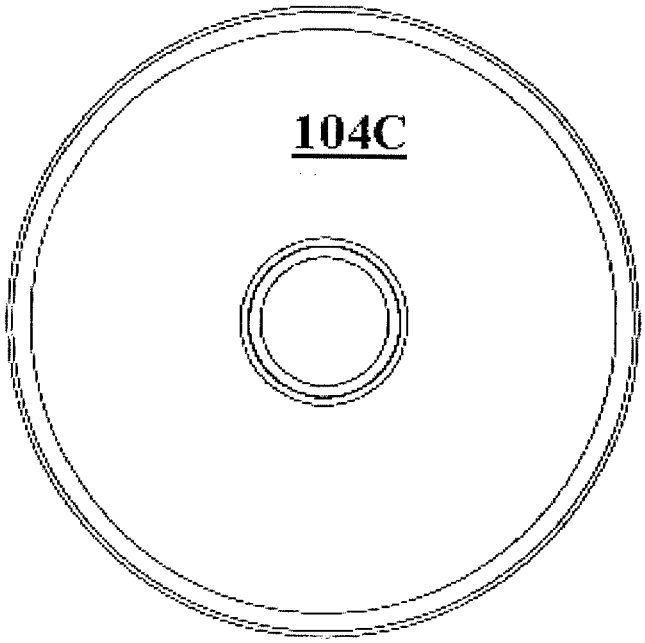
Figure 3E:
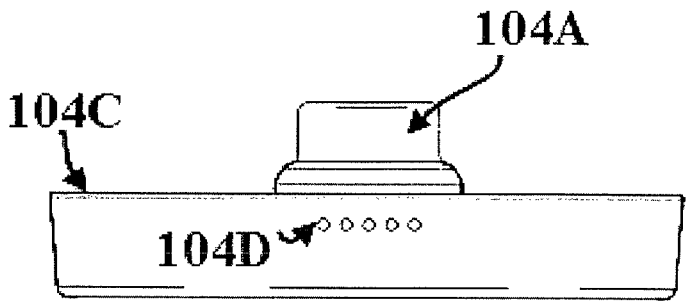
Figure 3F:
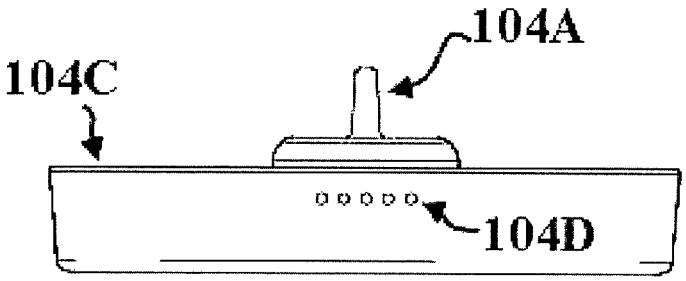

FIGS. 2A-2E illustrate the cover portion 102 of the microwave steam cover 100 in accordance with some embodiments of the present invention. FIG. 2A is a prospective view of the cover portion 102. FIG. 2B is a tilted bottom view of the cover portion 102. FIG. 2C is a top view of the cover portion 102. FIG. 2D is a bottom view of the cover portion 102. FIG. 2E is a side view of the cover portion 102.

FIGS. 3A-3F illustrate the steam generator 104 of the microwave steam cover 100 in accordance with some embodiments of the present invention. In addition to the descriptions above, the steam generator 104 is able to comprise a neck 104E which goes through and snug fit the main opening 102A. In some embodiments, the steam generator 104 comprises steam holes 104D allowing steam coming out from the dish structure 104C into the space under/inside the cover 102. In some embodiments, the top of the dish structure touches the bottom side of the cover 102 when installed, so no or not much gap between the dish structure 104 and the bottom side of the cover 102. Accordingly, the steam holes 104D allows steam to flow into the space under/inside the cover 102.

Figure 4A:
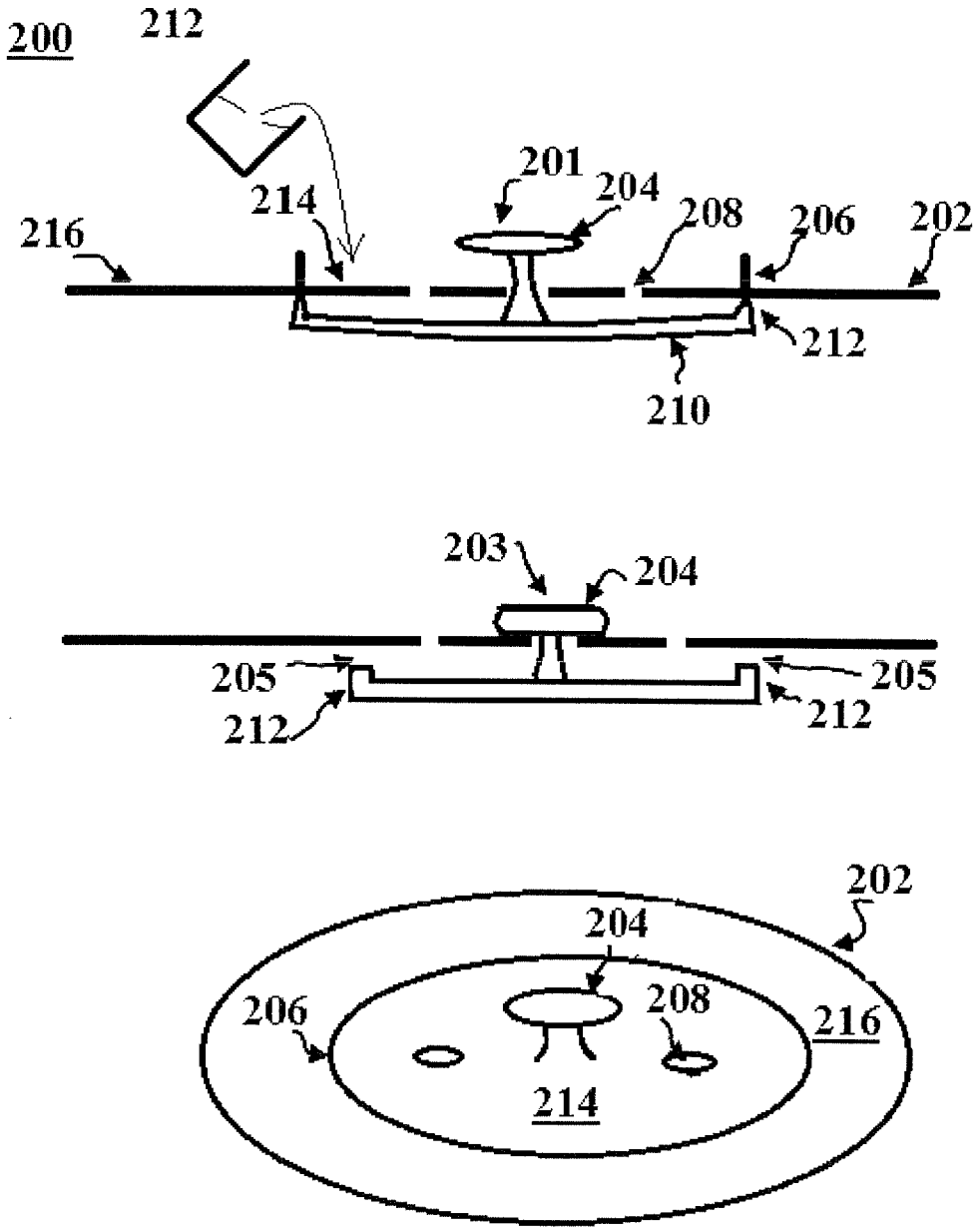
FIGS. 4A and 4B illustrate a microwave lid in accordance with some embodiments of the present invention.
Figure 4B:
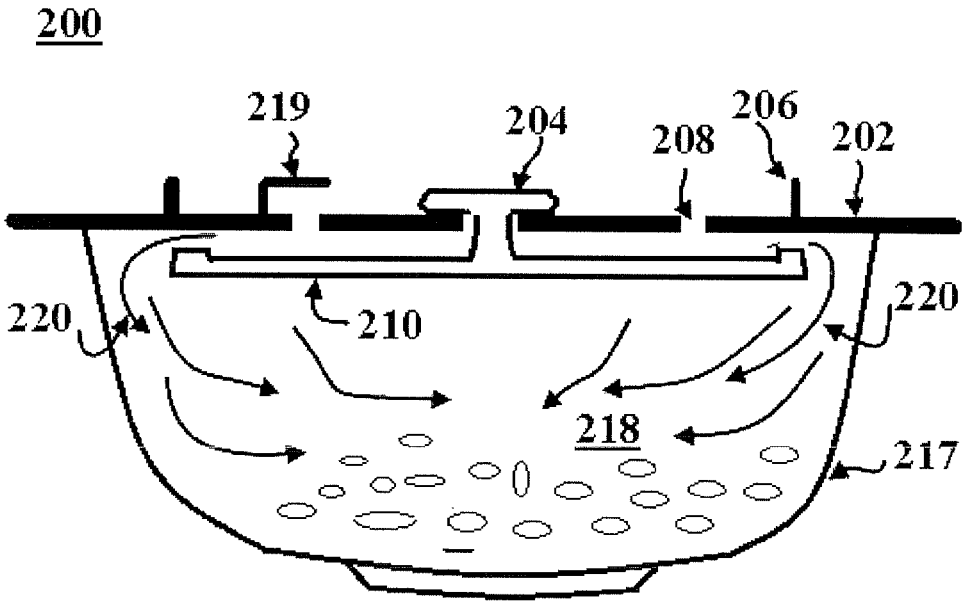

FIGS. 4A and 4B illustrate a microwave lid 200 in accordance with some embodiments of the present invention. In some embodiments, the microwave lid 200 comprises a lid portion 202 and a water container 210. The lid portion 202 is able to comprise a substantially planar body. In some embodiments, the lid portion 202 is rigid not bendable. In some other embodiments, the lid portion is flexible such that it can snug fit, such as deformation by gravity, most of the contour of the top of a food container.

In some embodiments, the water container 210 comprises a handle 204. The handle 204 can be positioned in a seal position 201 and an open position 203. At the seal position, the handle 204 is able to be pulled up by a user, such as when lifting the handle 204, so the side of the water container 212 is in contact with the bottom of the lid portion 202 and the side of the water container 212 forms a seal preventing heated hot water from dripping out of the water container 210 when it is tilted. At the open position 203, the handle 204 rests on the top side of the lid portion 202. Accordingly, the side of the water container 212 is not in touch with the lid portion 202 forming an opening/gap 205. The open position 203 can be a position when the microwave lid 200 is been used on a food container for heating up food, such that steam generated from heating up the water is able to come out from the opening 205 and cover the food. The seal/open position function is able to be applied to some or all the embodiments of the present invention.

The open and seal position 201 and 203 function is able to be a safety function. In some embodiments, the handle 204 connects with the water container 210 with a smaller stem. When a user lifts the handle 204, such as when moving/carrying the microwave lid 200, the side of the water container 212 defines and stops a vertical up movement of the water container 210, which forms an automatic sealing function preventing heated water from spilling from the gap 205. When the user's hand leaves the handle 204, weight of the water container 210 makes the water container 210 automatically fall into an open position 203, which opens up the gap 205 for steam to come out when the water is heated.

When in use, water is able to be poured on the lid portion 202 and flow through the holes 208 to the water container 210. The raised barrier 206 can confine and retain water within a pre-defined boundary. In some embodiments, the microwave lid 200 comprises an outer ring area 216 higher than the inner ring recessed area 214, such that the water can be retained in the inner ring recessed area 214.

FIG. 4B illustrates a use of the microwave lid 200 in accordance with some embodiments of the present invention. The microwave lid 200 is placed on a bowl 217. The lid portion 202 is snug fit on the bowl 217. Water is able to be added on the lid portion 202 and flow in to the water container 210. After applying a microwave radiation, water is heated to become vapor/steam 220, which is able to come out to keep the food 218 moisturized.

Figure 5A:
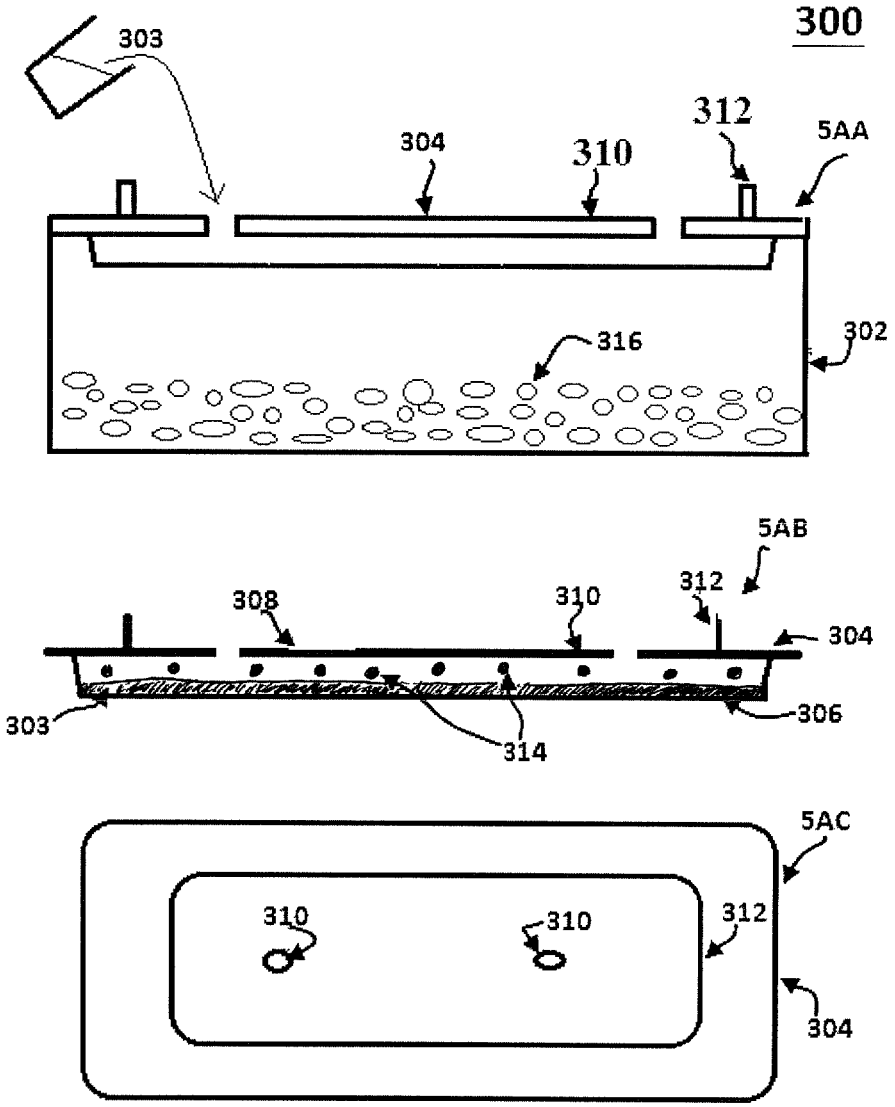
FIG. 5A illustrates a lunch box set in accordance with some embodiments of the present invention.

FIG. 5A illustrates a lunch box set 300 in accordance with some embodiments of the present invention. The set 300 can comprise a cover 304 and a food container 302. Water or any other liquid 303, such as nutrient liquid (e.g., vitamin and soy sauce), is added to the top 308 of the cover 304. The water 303 flows to the water chamber 306 through the holes 310. The barrier 312 is able to ensure water 303 added flows to the chamber 316. The water is able to retain in the chamber 306, because the steam holes 314 is placed at a pre-determined height of the chamber 306, which is higher than the added water level. The steam holes 306 allow steam to come out when the water receives some amount of microwave energy. View 5AA is a side view of the lunch box set 300. View 5AB is the side view of the cover 304. View 5AC is a top view of the cover 304.

Figure 5B:
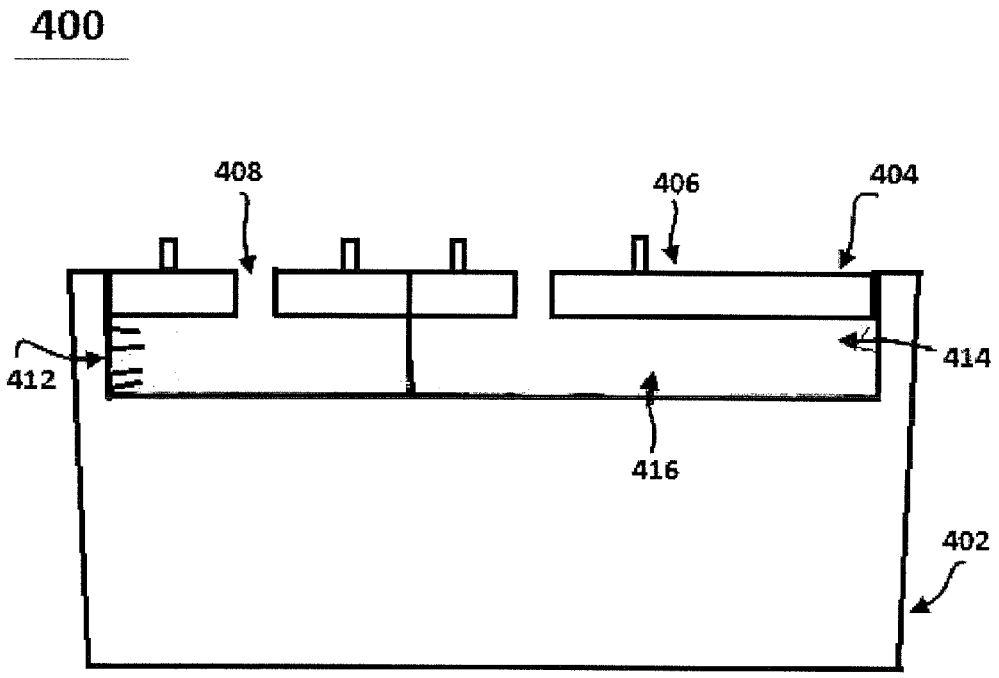
FIG. 5B illustrates another food container in accordance with some embodiments of the present invention.

FIG. 5B illustrates another food container 400 in accordance with some embodiments of the present invention. Similar to the lunch box set 300, the food container 400 comprises a steamer 404 and a box 402. The box 402 is able to be plastic boxes like Tupperware®. In some embodiments, the steamer 404 comprises a first chamber 406 isolated from the second chamber 408, such that two different liquids can be added to the first and the second chambers 406 and 408 without mixing. The steamer 404 can comprise steam holes 414 near the top of the steamer 404. In some embodiments, water or liquid can be added below the steam holes 414 so that water/liquid does not drip into the food to be heated. In other embodiments, the sizes of the steam holes are small enough so that water does not dip out because of surface tension. In some embodiments, the steamer 404 comprises a meter 412 such that the volume of water added is able to be controlled and/or measured.

Figure 6:
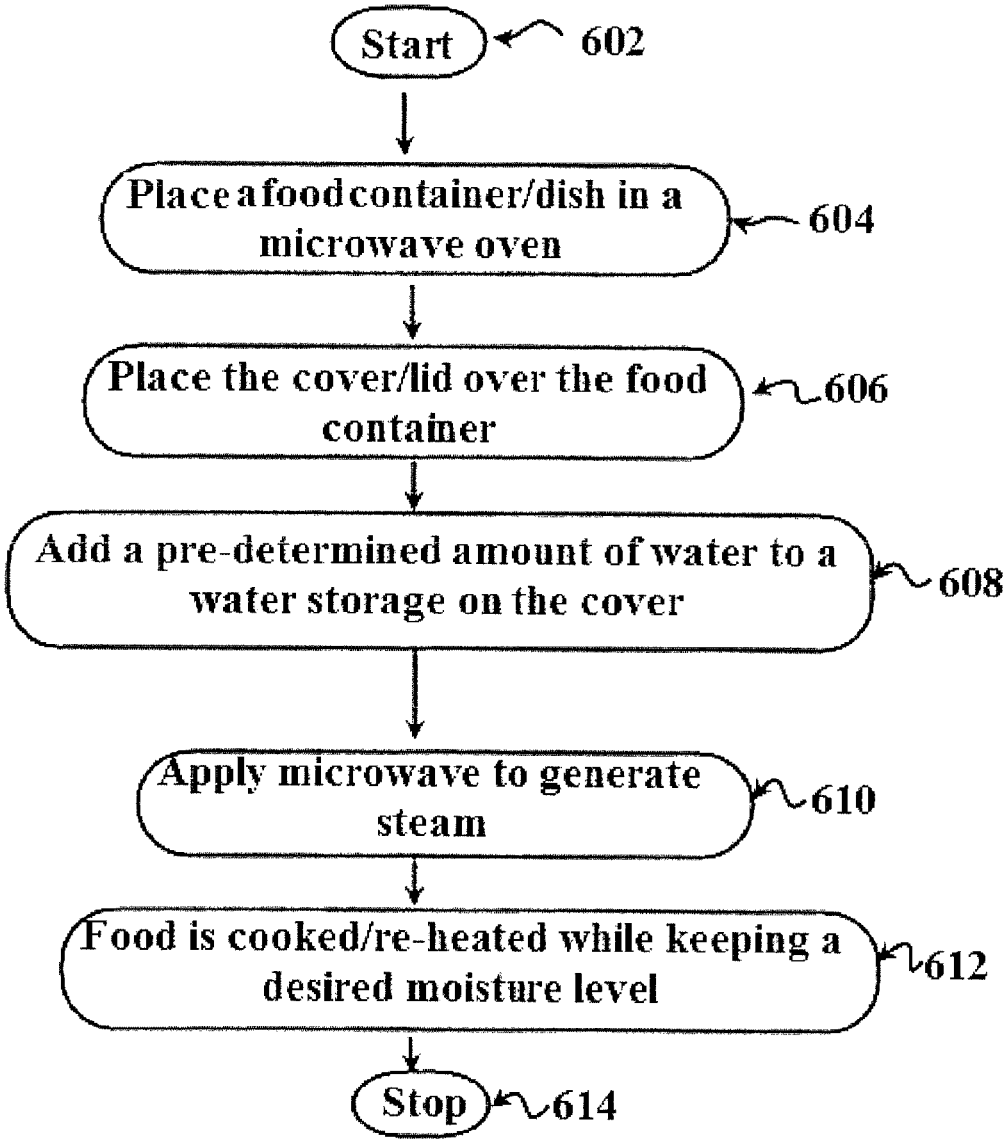
FIG. 6 is a flow chart illustrating a method of using the microwave cover in accordance with some embodiments of the present invention.
Figure 7A:
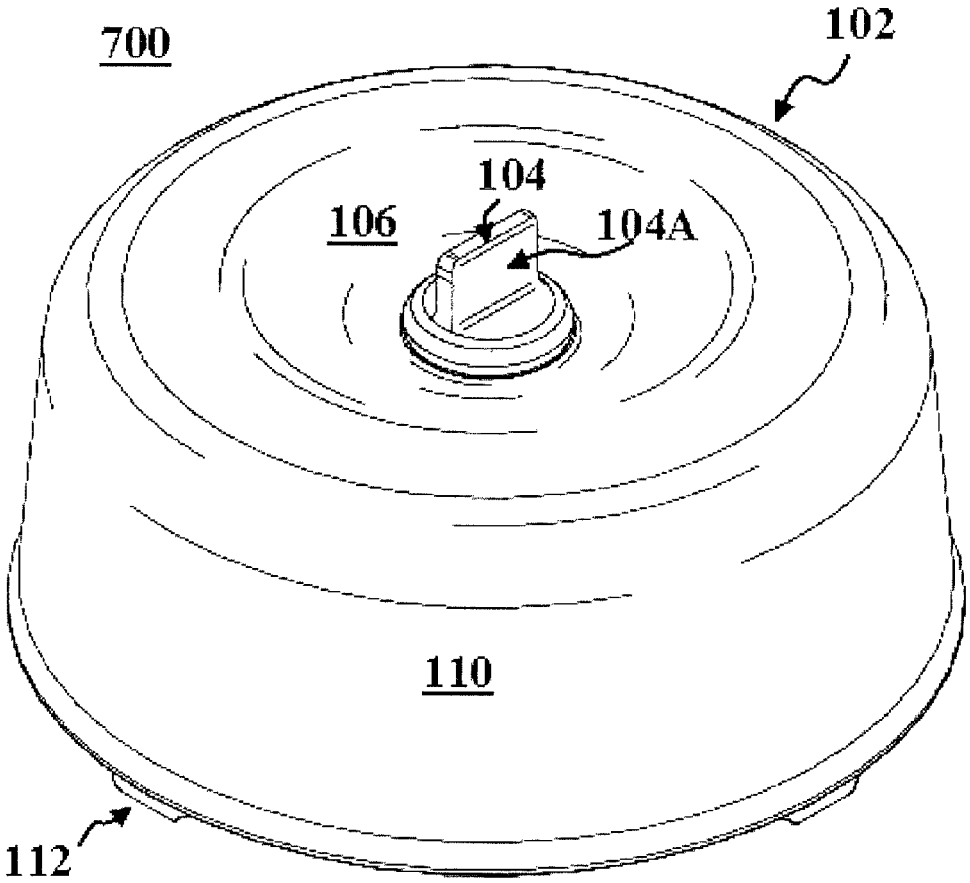
FIGS. 7A-7G illustrate another microwave steam cover in accordance with some embodiments of the present invention.
Figure 7B:
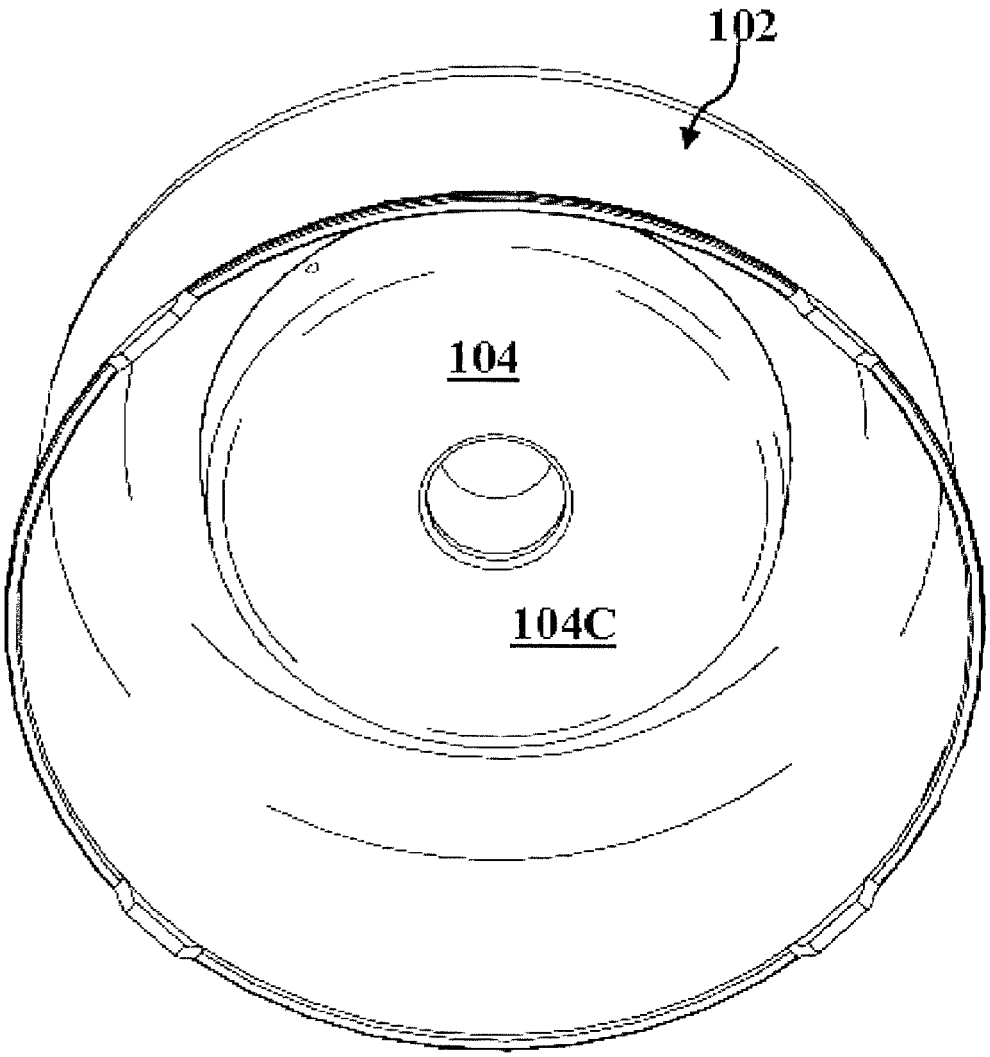
Figure 7C:
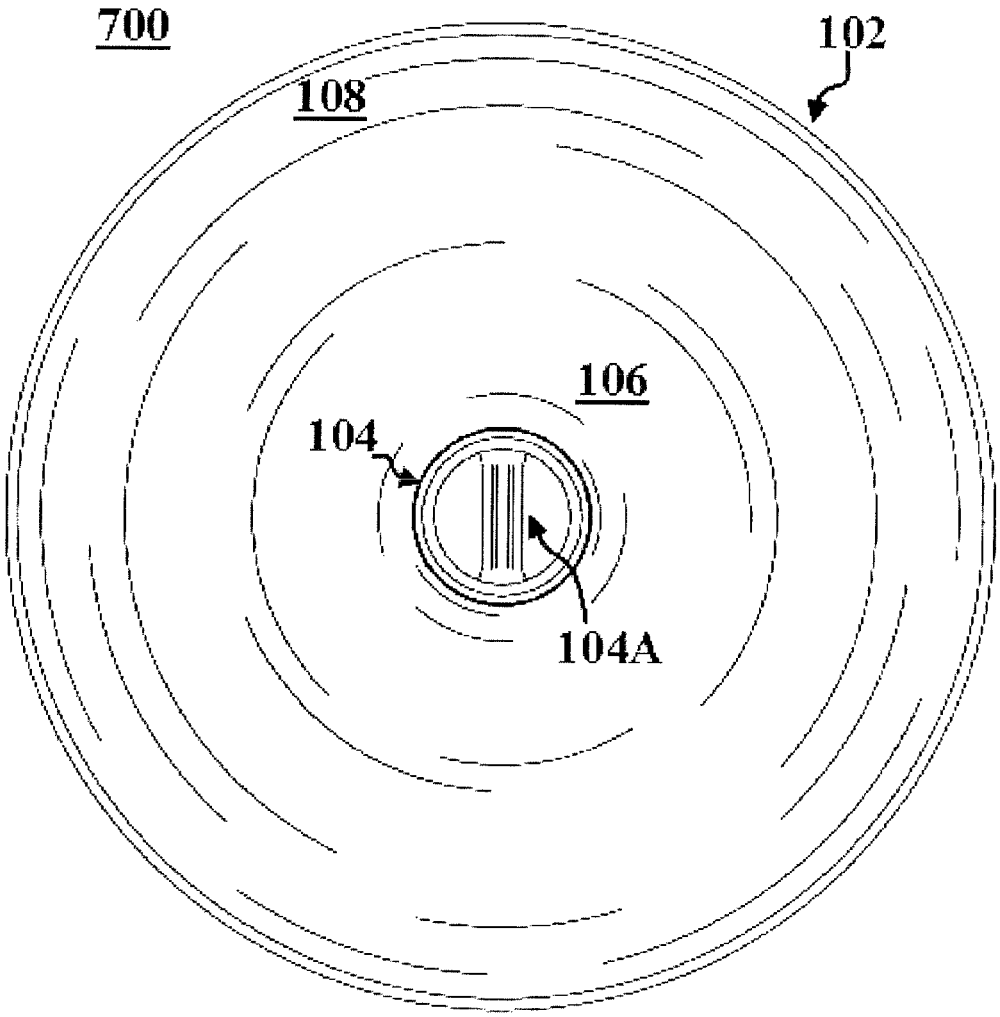
Figure 7D:
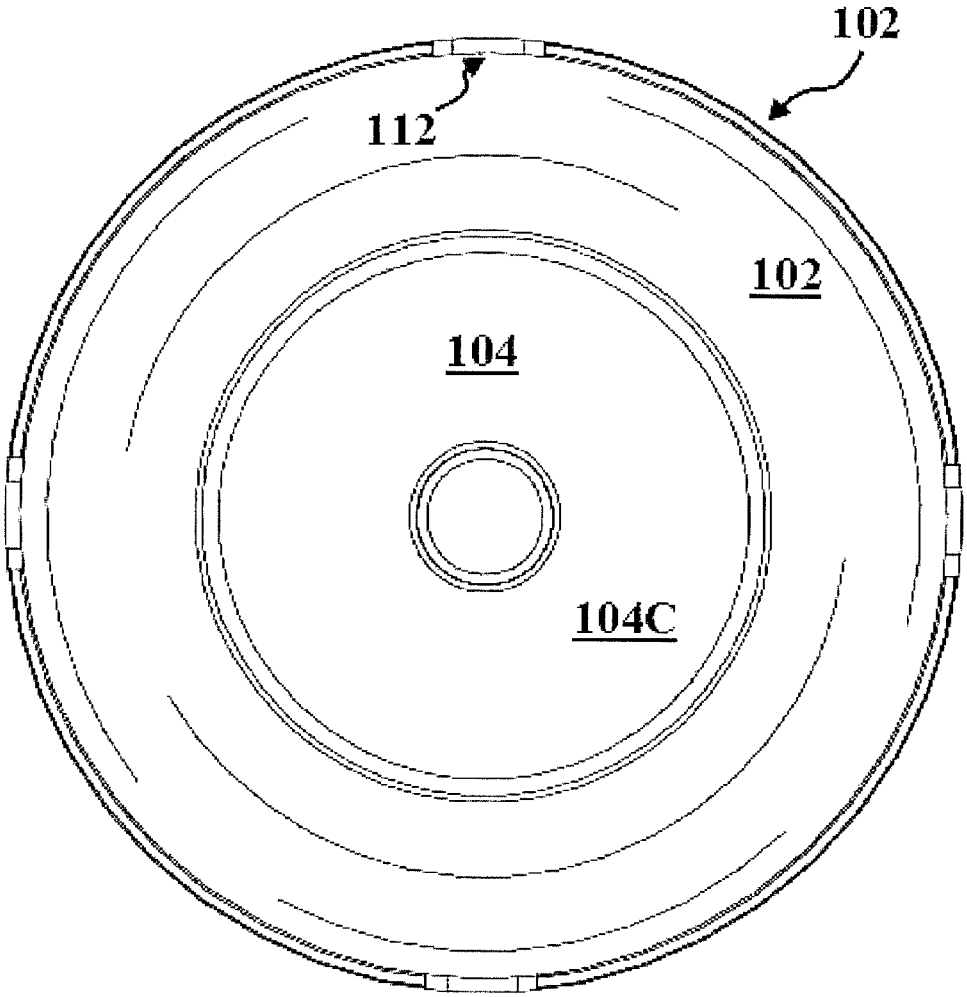
Figure 7E:
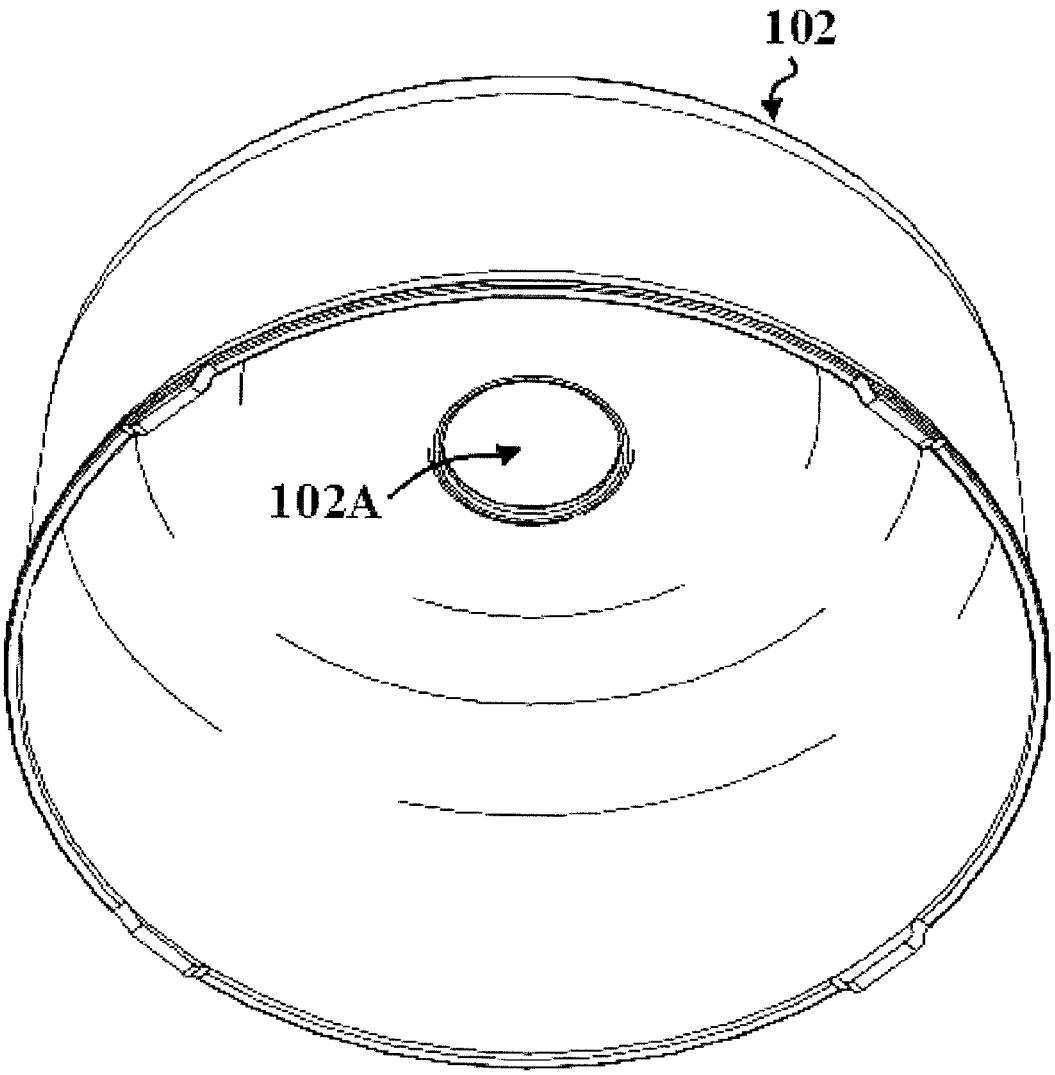
Figure 7F:
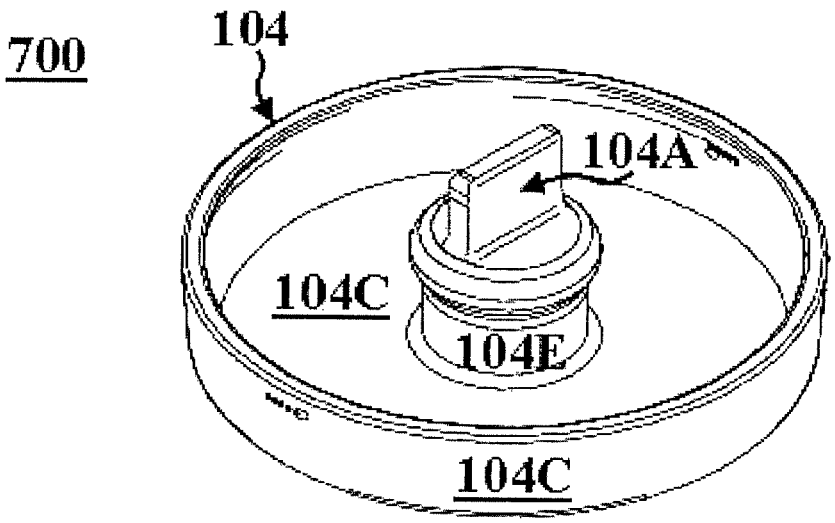
Figure 7G:
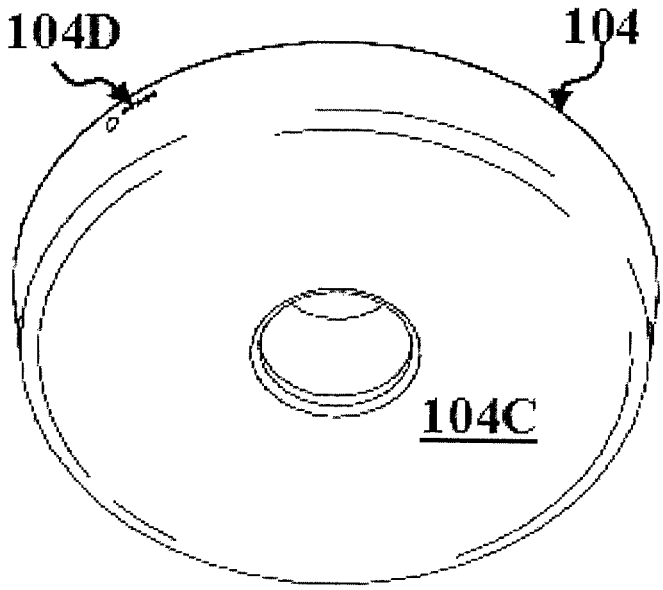

FIG. 6 is a flow chart illustrating a method 600 of using the microwave cover in accordance with some embodiments of the present invention. The method 600 starts from a step 602. At step 604, a food container/dish with food to be heated is placed in a microwave oven. At step 606, a microwave cover/lid is placed over the food container. At step 608, a pre-determined amount of water is added to a water storage of the cover. At step 610, microwave is applied to the water on the cover to generate steam. At step 612, food is re-heated while keep a desired moisture level.

FIGS. 7A-7G illustrate another microwave steam cover 700 in accordance with some embodiments of the present invention. The microwave steam cover 700 is similar to the microwave cover steam cover 100, whereas the cover 700 does not contain a water stopper 104B and the cover does not contain a side hole 102B. The water flowing mechanism of the cover 700 from the cover water storage 106 to the steam generator 104 is by pulling the handle 104A upward making holes between the hole on the cover and the stem of the steam generator 104. The same number used to refer the components in the FIGS. 7A-7G refers to the same components used in FIGS. 1A-1E.

A person of ordinary skill in the art appreciate that the term "cover" used in the present specification, in some embodiments, comprises a cover (having a side wall structure) and a lid (without having a side wall structure). In some embodiments, the term "cover" also comprises a typical microwave splatter cover that is commercially available on the market.

The microwave cover disclosed herein is able to be used in reheating food. The meaning of "reheating food" includes heating food that has been previously cooked. The microwave cover disclosed herein is also able to be used to cook food. The meaning of "cook food" includes turning raw food or uncooked edible material or substance to a cooked state or more cooked state, such as from raw to rare, from rare to medium well, or from raw to well done or over cooked.

In some embodiments, the steam generator is able to be on the other location other than on the cover. For example, the steam generator is able to be on a bottom tray and a cover without a steam generator is used to cover the bottom tray. In another example, a bottom tray and a cover both contain one or more steam generators.

The microwave cover can be utilized to keep the reheated food having an ideal moisture level.

In operation, the microwave cover is used to cover the dish with food to be re-heated. Next, water is added to the microwave cover to generate steam. The provided steam environment keeps the moisture of the food locked inside the food and/or adds moisture to the food.

The description is presented to enable one of ordinary skill in the art to make and use the invention. Various modifications to the described embodiments are readily apparent to those persons skilled in the art and the generic principles herein can be applied to other embodiments. Thus, the present invention is not intended to be limited to the embodiments shown but is to be accorded the widest scope consistent with the principles and features described herein. It is readily apparent to one skilled in the art that other modifications can be made to the embodiments without departing from the spirit and scope of the invention as defined by the appended claims.

What is claimed is:

1. A microwave food heating device comprising:

a. a microwaveable cover portion; and b. a steam generator having a dish structure coupled with the cover portion, wherein the steam generator is between the cover portion and a space for food to be heated such that steam generated is moving downward to cover the food heated, wherein the steam generator comprises a handle going through an aperture near a center portion of the cover portion.

2. The device of claim 1, wherein the cover portion comprises a water storage recess.

3. The device of claim 1, wherein the steam generator comprises a water container.

4. The device of claim 3, wherein the water container comprises a dish structure.

5. The device of claim 3, further comprising a gap allowing steam to pass between the dish structure and a bottom side of the cover portion.

6. The device of claim 1, wherein the handle comprises a water stopper.

7. The device of claim 1, wherein the handle is rotatably coupled with the center portion of the cover portion.

8. The device of claim 1, wherein the water stopper closes a hole in the cover when the handle rotates to a predetermined position.

9. The device of claim 1, wherein the steam generator is made of silicone.

10. The device of claim 1, wherein the cover portion is made of polypropylene.

11. A microwave splatter cover comprising:

a. a microwaveable cover structure; and b. a steam generator containing a water container having a dish structure coupled with the cover structure, wherein the water container is on top of food to be heated, wherein the steam generator comprises a handle going through an aperture near a center portion of the cover structure and having a solid body.

12. The cover of claim 11, wherein the dish structure comprises a body substantially parallel to a top portion of the cover structure.

13. The cover of claim 11, wherein the cover structure comprises a fluid path, which couples with the water container.

14. The cover of claim 11, wherein the cover structure comprises a recess allowing water to be temporary stored until a hole in the cover structure is opened for draining the water to the water container.

15. The cover of claim 11, wherein the water container is instantly attachable to and detachable from the cover structure.

16. A method of retaining water in a microwave reheating food comprising:

a. generating steam at a water chamber having a dish structure coupled with a microwaveable cover structure from added water by using a microwave radiation, wherein the water chamber is between the cover structure and the food, wherein the water chamber comprises a handle going through an aperture near a center portion of the cover structure and having a solid body; and b. covering the food with the steam.

17. The method of claim 16, further comprising pouring the water on the cover structure.

18. The method of claim 16, further comprising temporarily storing the water on the cover structure and allowing the water to flow to the water chamber.

19. The method of claim 16, wherein the water chamber is rotatably coupled with an aperture approximately at a center of the cover structure.

* * * * *